US010451292B2

(12) United States Patent
De Los Toyos Lopez et al.

(10) Patent No.: US 10,451,292 B2
(45) Date of Patent: Oct. 22, 2019

(54) RADIANT HEATER FOR A COOKTOP

(71) Applicant: EIKA, S. COOP., Etxebarria (ES)

(72) Inventors: Daniel De Los Toyos Lopez, Eibar (ES); Jon Endika Azpiritxaga Zalbide, Durango (ES)

(73) Assignee: EIKA, S. COOP., Etxebarria (ES)

( * ) Notice: Subject to any disclaimer, the term of this patent is extended or adjusted under 35 U.S.C. 154(b) by 859 days.

(21) Appl. No.: 14/959,305

(22) Filed: Dec. 4, 2015

(65) Prior Publication Data

US 2016/0174299 A1 Jun. 16, 2016

(30) Foreign Application Priority Data

Dec. 11, 2014 (ES) ..... 201431610 U

(51) Int. Cl.
*H05B 6/06* (2006.01)
*F24C 15/10* (2006.01)
*H05B 6/12* (2006.01)

(52) U.S. Cl.
CPC ..... *F24C 15/102* (2013.01); *H05B 2213/07* (2013.01)

(58) Field of Classification Search
CPC ..... F24C 15/102; H05B 3/74; H05B 2213/07
USPC ..... 219/448.17; 29/428
See application file for complete search history.

(56) References Cited

U.S. PATENT DOCUMENTS 3,578,951 A * 5/1971 Ingrao ..... F24C 15/102 219/403
3,674,983 A * 7/1972 Hurko ..... H05B 3/748 219/436
3,771,945 A * 11/1973 Teague, Jr. ..... F24H 3/006 126/92 C
3,810,249 A * 5/1974 McGowan ..... F25B 49/04 337/1
3,895,216 A * 7/1975 Hurko ..... F24C 15/104 219/435
3,933,419 A * 1/1976 Romanelli ..... F23N 5/025 431/66
3,971,361 A * 7/1976 Hurko ..... A47J 36/04 126/390.1
4,110,065 A * 8/1978 Fujiwara ..... F23Q 9/08 126/39 E
4,125,356 A * 11/1978 Ohashi ..... F23D 14/72 431/76
4,201,184 A * 5/1980 Scheidler ..... F24C 3/047 126/214 A
4,237,368 A * 12/1980 Welch ..... G05D 23/24 219/448.12

(Continued)

FOREIGN PATENT DOCUMENTS

EP 2626638 A1 8/2013
GB 1569588 6/1980

*Primary Examiner* — Eric S Stapleton
(74) *Attorney, Agent, or Firm* — Edell, Shapiro & Finnan, LLC

(57) ABSTRACT

According to one implementation a radiant heater is provided that includes a cover, an insulating base arranged on the cover, at least one resistance element fixed to the insulating base, a temperature sensor suitable for measuring the temperature of a cooktop arranged on the radiant heater, and a flat resilient member suitable for keeping the temperature sensor in constant contact with the cooktop in a final assembly position.

7 Claims, 3 Drawing Sheets

(56) References Cited

U.S. PATENT DOCUMENTS 4,394,564 A * 7/1983 Dills ..... H05B 3/68 219/448.17
4,414,465 A * 11/1983 Newton ..... F24C 15/105 219/405
4,640,680 A * 2/1987 Schilling ..... F23D 14/64 431/347
4,706,644 A * 11/1987 Nakai ..... B60H 1/032 122/20 B
4,712,997 A * 12/1987 Fullemann ..... F23D 11/005 239/214.25
4,740,664 A * 4/1988 Payne ..... G05D 23/24 219/448.12
4,762,488 A * 8/1988 Schilling ..... F23D 14/64 431/350
4,770,161 A * 9/1988 Charron ..... F23N 1/085 122/14.21
4,797,088 A * 1/1989 Nakamura ..... F23D 3/28 431/15
4,816,647 A * 3/1989 Payne ..... F24C 15/106 219/448.12
4,851,645 A * 7/1989 Wolf ..... G01K 1/14 219/448.17
4,864,104 A * 9/1989 Crossley ..... H05B 3/744 219/462.1
4,934,924 A * 6/1990 Nakai ..... B60H 1/2209 237/12.3 C
4,978,291 A * 12/1990 Nakai ..... B60H 1/032 237/2 A
5,139,007 A * 8/1992 Bertomeu Martinez ..... F24C 3/067 126/39 D
5,183,997 A * 2/1993 Lotz ..... H05B 3/744 219/455.12
5,223,697 A * 6/1993 Wilde ..... H05B 3/746 219/447.1
5,227,610 A * 7/1993 Schultheis ..... G05D 23/24 219/445.1
5,243,172 A * 9/1993 Hazan ..... F24C 15/106 219/447.1
5,296,682 A * 3/1994 Wittauer ..... H05B 3/746 219/447.1
5,320,518 A * 6/1994 Stilger ..... B01J 8/06 122/4 D
5,491,423 A * 2/1996 Turetta ..... H05B 3/746 219/447.1
5,919,385 A * 7/1999 Kersten ..... H05B 3/744 219/448.11
6,072,165 A * 6/2000 Feldman ..... G01K 7/02 136/200
6,226,990 B1 * 5/2001 Conrad ..... F02G 1/0435 60/520
6,269,639 B1 * 8/2001 Conrad ..... F02G 1/0435 60/515
6,269,640 B1 * 8/2001 Conrad ..... F25B 9/14 60/515
6,279,318 B1 * 8/2001 Conrad ..... F02G 1/0435 60/520
6,279,319 B1 * 8/2001 Conrad ..... F02G 1/0435 60/515
6,286,310 B1 * 9/2001 Conrad ..... F02G 1/0435 60/520
6,293,101 B1 * 9/2001 Conrad ..... F02G 1/0435 60/520
6,311,490 B1 * 11/2001 Conrad ..... F02G 1/0435 60/520
6,311,491 B1 * 11/2001 Conrad ..... F02G 1/0435 60/520
6,332,319 B1 * 12/2001 Conrad ..... F02G 1/0435 60/515
6,336,326 B1 * 1/2002 Conrad ..... F02G 1/0435 60/515
6,345,666 B1 * 2/2002 Conrad ..... F02G 1/0435 165/141
6,384,387 B1 * 5/2002 Owens ..... A47J 36/2483 219/387
6,462,316 B1 * 10/2002 Berkcan ..... H05B 3/746 219/447.1
6,521,870 B2 * 2/2003 Nolan ..... F24C 15/325 126/21 A
6,580,058 B2 * 6/2003 Gratz ..... H05B 3/746 219/448.11
6,752,531 B2 * 6/2004 McWilliams ..... H05B 1/0266 219/412
6,753,509 B2 * 6/2004 Gratz ..... H05B 3/746 219/448.11
6,994,056 B1 * 2/2006 Boros ..... F23D 14/04 122/14.1
7,307,246 B2 * 12/2007 Smolenski ..... G01K 1/14 219/446.1
7,573,003 B2 * 8/2009 Gratz ..... H05B 3/746 219/448.11
8,258,437 B2 * 9/2012 Donarski ..... H05B 1/0266 219/443.1
2003/0019863 A1 * 1/2003 Gratz ..... H05B 3/746 219/448.17
2003/0024923 A1 * 2/2003 Gratz ..... H05B 3/746 219/452.12
2003/0029858 A1 * 2/2003 Gratz ..... H05B 3/746 219/448.17
2003/0042246 A1 * 3/2003 Gratz ..... H05B 3/746 219/448.14
2003/0080111 A1 * 5/2003 Blanchard ..... H05B 3/746 219/492
2003/0121259 A1 * 7/2003 Conrad ..... F02G 1/0435 60/508
2005/0247693 A1 * 11/2005 Fisher ..... H05B 1/0266 219/445.1
2005/0286609 A1 * 12/2005 Smolenski ..... G01K 1/14 374/141
2008/0308087 A1 * 12/2008 Rosenzweig ..... F24C 15/12 126/14
2009/0117505 A1 * 5/2009 Okayasu ..... F23D 14/60 432/221
2010/0015559 A1 * 1/2010 Whitford ..... F23N 5/242 431/75
2011/0192830 A1 * 8/2011 Wilson ..... F24C 7/10 219/386
2012/0000903 A1 * 1/2012 Baarman ..... A47J 27/002 219/620
2012/0132647 A1 * 5/2012 Beverly ..... H05B 6/062 219/624
2014/0227411 A1 * 8/2014 Popeil ..... A47J 37/1209 426/302
2014/0311355 A1 * 10/2014 Hegarty ..... A21B 1/40 99/331
2014/0348987 A1 * 11/2014 Cheng ..... A47J 27/04 426/231

* cited by examiner

RADIANT HEATER FOR A COOKTOP

CROSS-REFERENCE TO RELATED APPLICATIONS

This application relates to and claims the benefit and priority to Spanish Application No. 201431610, filed Dec. 11, 2014.

TECHNICAL FIELD

The present invention relates to a radiant heater for a cooktop. Particularly, it relates to a radiant heater including a sensor suitable for measuring the temperature of the cooktop, which may be a vitroceramic cooktop.

BACKGROUND

Cooking apparatus are known comprising radiant heaters adapted to a cooktop, which include temperature sensors the objective of which is to measure the temperature of the glass ceramic stovetop through which the temperature of the cookware that is arranged on the corresponding radiant heater can be controlled. For example, possible fires due to oil overheating in the cookware, forgetting the cookware on the radiant heater in operation can thereby be prevented, and/or the cooking of the food can also be controlled at all times as the temperature thereof is directly controlled.

Patent document GB 1,569,588 discloses a cooking apparatus comprising a radiant heater comprising a sensor element extending to the glass ceramic stovetop. The sensor element is arranged inside a tubular body going through an insulating base of the radiant heater on which the resistance of the radiant heater is arranged in a fixed manner.

Patent document EP 2626638 A1 discloses a cooking apparatus comprising a radiant heater comprising a sensor element making contact with the lower surface of the glass ceramic stovetop, a spring supported at one end in the radiant heater whereas the other end presses the temperature element against the glass ceramic stovetop. The elastic force with which a part the spring presses the sensor element against the glass ceramic stovetop is less than the elastic force with which the spring presses the radiant heater towards the glass ceramic stovetop.

SUMMARY OF THE DISCLOSURE

According to one implementation a radiant heater is provided that comprises a metal cover, an insulating base arranged on the cover, at least one resistance fixed to the insulating base, a temperature sensor suitable for measuring the temperature of the cooktop, and elastic means suitable for keeping the temperature sensor in permanent contact with the cooktop in a final assembly position.

The elastic means comprises a flat fixed to the cover at one end, the temperature sensor, according to some implementations, being fixed to the flat. In the final assembly position, the flat is arranged in a tensed manner forming an angle with the cover such that it pushes the temperature sensor against the cooktop. It thereby maintains the temperature sensor pressed against the cooktop, maintaining constant contact between both, such that the temperature sensor is able to measure the temperature of the cooktop at all times. It is understood that the temperature of the cooktop and the temperature of cookware arranged on the radiant heater are generally very similar. Therefore, in addition to preventing possible accidents due to very hot oils, forgetting to switch off the radiant heater, etc., the cooking of the food can be controlled continuously.

These and other advantages and features will become evident in view of the drawings and detailed description.

DETAILED DESCRIPTION

Figure 1:
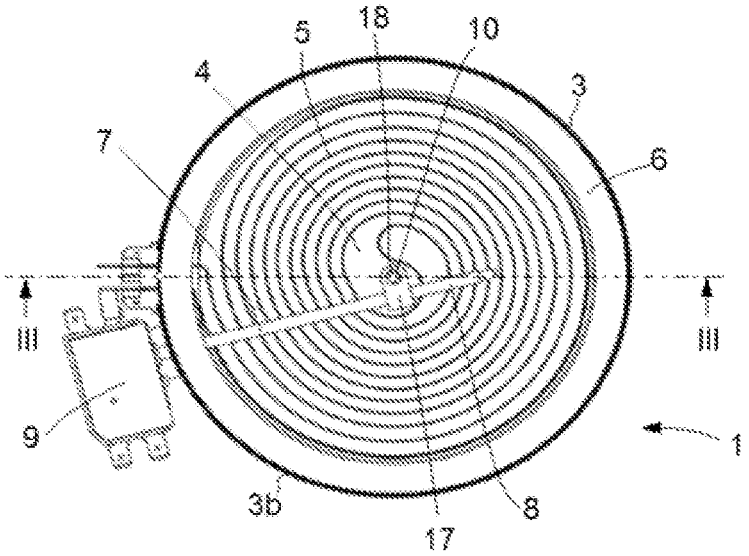
FIG. 1 shows a plan view of a radiant heater according one embodiment.

FIGS. 1 to 4 show a radiant heater 1 arranged below a cooktop 2, such as a glass ceramic cooktop. According to one embodiment the radiant heater comprises a metal cover 3, a cylindrical insulating base 4 made of a thermally and electrically insulating material and arranged housed inside the cover 3, and at least one resistance element 5 disposed on the insulating base 4. The cover 3 may have a circular cookware shape, the insulating base 4 being arranged such that it is supported on a bottom 3*b* of the cover 3.

The radiant heater 1 may further comprise an insulating ring 6, supported on the insulating base 4 and housed at least partially in the cover 3. The insulating ring 6 makes contact with an inner surface 2*b* of the cooktop 2 in a final assembly position shown in detail in FIG. 4. In other non-depicted embodiments, the insulating ring 6 and the insulating base 4 can form a single piece.

Figure 4:
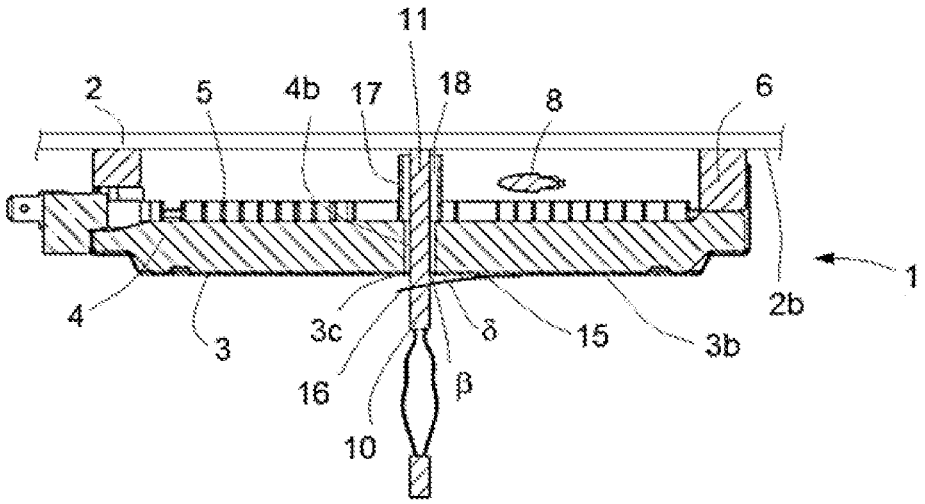
FIG. 4 shows the cross-section according to section line III-III of the radiant heater shown in FIG. 1, in the final assembly position below the cooktop.
Figure 5:
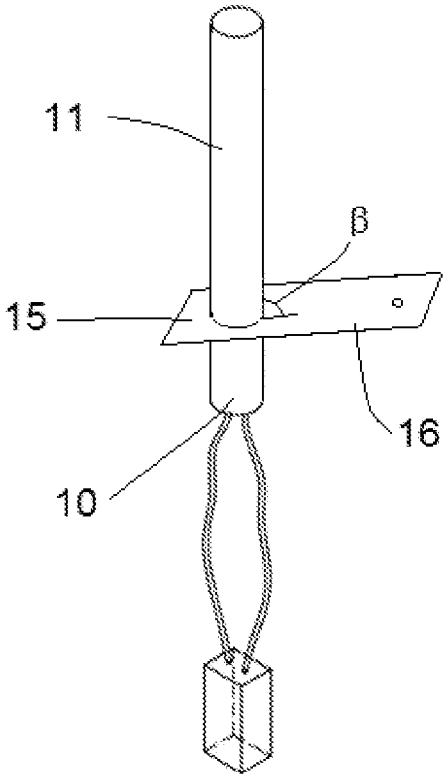
FIG. 5 shows in detail a temperature sensor comprised in the radiant heater shown in FIG. 1.

The radiant heater 1 further comprises a temperature sensor 10 that extends axially through the radiant heater 1. When the radiant heater 1 is assembled in the corresponding cooking apparatus in the final assembly position, the temperature sensor 10 is arranged in contact with the lower surface 2*b* of the glass ceramic stovetop 2 as shown in FIG. 4. According to one implementation the temperature sensor 10 is an RTD (resistance temperature detector) sensor.

The radiant heater 1 further comprises elastic means 15 that maintains the temperature sensor 10 in constant contact with the cooktop 2. The elastic means 15 comprises a flat 16 that is arranged such that it is fixed to the cover 3 at one end. For example, it may be arranged such that it is fixed to the bottom 3*c* of the cover 3. The flat 16 may be fixed to the cover 3 by the uses of one or more screws, or by any of a variety of other methods. The flat 16 has a free end that is not fixed to the cover 3.

According to one implementation a body 11 of the temperature sensor 10 passes through and is fixed to the flat 16. The temperature sensor 10 can be fixed to the flat 16 by any known method, such as welding, adhesives, plastic strain of the body 11, or other known mechanical means. The temperature sensor 10 is arranged passing through the cover 3 and the insulating base 4. According to other implementations the temperature sensor 10 may be fixed to a side of the flat 16 rather than passing through the flat.

Figure 3:
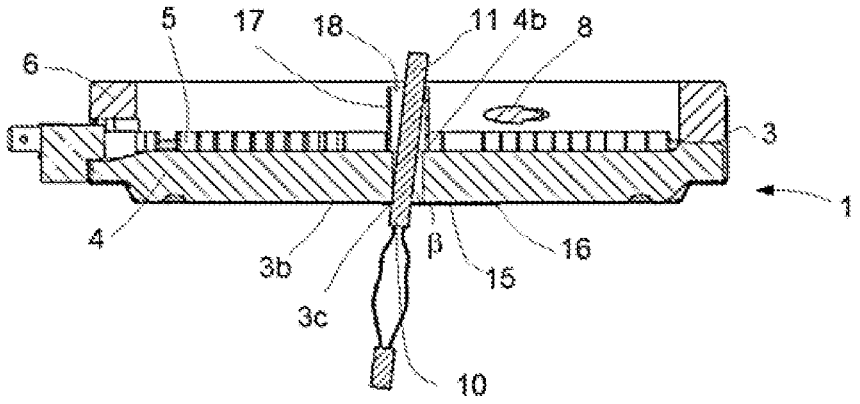
FIG. 3 shows a cross-section according to section line III-III of the radiant heater shown in FIG. 1, before the assembly thereof in a cooking apparatus.

According to one embodiment the radiant heater 1 comprises a support 17 that is arranged such that it is supported on the insulating base 4. In the embodiment shown in the drawings, the support 17 is arranged such that it is centered with respect to the insulating base 4. The support 17 has a first hole 18 that is arranged vertical or substantially vertical. The hole 18 having a central axis that is orthogonal, or substantially orthogonal to the cooktop surface when the cooktop 2 and heater 1 are assembled together. Prior to the cooktop 2 being assembled on the heater 1, the temperature sensor 10 projects from the support 17 as illustrated in FIG. 3.

According to one embodiment the temperature sensor 10 is arranged such that it is fixed to the flat 16 forming an acute angle β with same. The body 11 of the temperature sensor 10 is then introduced in the radiant heater 1 through respective holes 3*c*, 4*b* and 18 of the cover 3, of the insulating base 4 and of the support 17, respectively, as shown in FIGS. 3 and 4. The elastic means 15 is then fixed to the cover 3 so that the flat 16 is arranged parallel, or substantially parallel, to the bottom 3*c* of the cover 3, as shown in FIG. 3. The size of the holes 3*c*, 4*b* and 18 permitting the temperature sensor 10 to maintain the angle β with respect to the bottom 3*c* of the cover 3. As shown in FIG. 3, after the elastic means 15 is assembled on the heater 1, the temperature sensor 10 projects beyond the insulating ring 6, so that end of the temperature sensor 10 makes contact with the cooktop 2 before the cooktop 2 makes contact with the insulating ring 6.

It is important to note that although the radiant heater 1 has been described as including a cover 3, other embodiments are contemplated that do not include a cover. For example, the mechanical integrity of the insulating base 4 may be such that no cover is necessary.

In a final assembly position, shown in detail in FIG. 4, the temperature sensor 10 is arranged orthogonal, or substantially orthogonal to the cooktop 2, making contact with the inner surface 2*b* of the cooktop 2. The manner by which the temperature sensor 10 is coupled to the radiant heater 1 results in the body 11 of the temperature senor 10 being straightened when the cooktop 2 is placed onto the radiant heater 1. (See comparison of FIG. 4 with FIG. 3.) As the temperature sensor 10 straightens to assume the orthogonal, or substantially orthogonal position, the free end of the flat 16 bends with respect the cover 3. In the final assembly position with the cooktop 2 arranged on the insulating ring 6, the free end of the flat 16 is arranged in a tensed manner forming an angle δ with the cover 3 such that it pushes the temperature sensor 10 against the inner surface 2*b* of the cooktop 2 as shown in FIG. 4. According to one embodiment the angle δ formed by the flat 16 with the cover 3 and the angle β formed by the temperature sensor 10 with the flat 16 are complementary or substantially complementary angles in that they add up to 90° or substantially 90°.

In the final assembly position, the end of the temperature sensor 10 makes contact with the inner surface 2*b* of the cooktop 2. The flat 16 applies a force on the temperature sensor 10, pushing it towards the cooktop 2 such that it assures a constant contact between the end of the temperature sensor 10 with the cooktop 2.

The radiant heater 1 may also comprise a temperature-limiting device 7 connected to the resistance element 5 and to a non-depicted control device of the radiant heater 1. In such an embodiment the temperature-limiting device 7 may comprise a second temperature sensor 8, such as of the dilatable rod or tube-type, that passes through the insulating ring 6 and extends over the insulating base 4 above the resistance element 5. An insulating support 9 is fixed to the outside of the wall 3*b* of the cover 3 by known fixing means. The insulating support 9 houses disconnect means (not shown in the figures) connected to the second temperature sensor 8. The second temperature sensor 8 is arranged between the resistance element 5 and the cooktop 2.

Each radiant heater 1 has an established maximum temperature that cannot be exceeded during operation to prevent potential damage to the cooktop 2, and to prolong its service life, the objective of the temperature-limiting device 7 being to limit the maximum or borderline temperature that can be reached by the radiant heater 1 when it has been operating for some time. Furthermore, the temperature-limiting device 7 has an established reset temperature, the reset temperature being a pre-established temperature that allows resetting the disconnect means, after which the temperature-limiting device 7 is deactivated.

Figure 2:
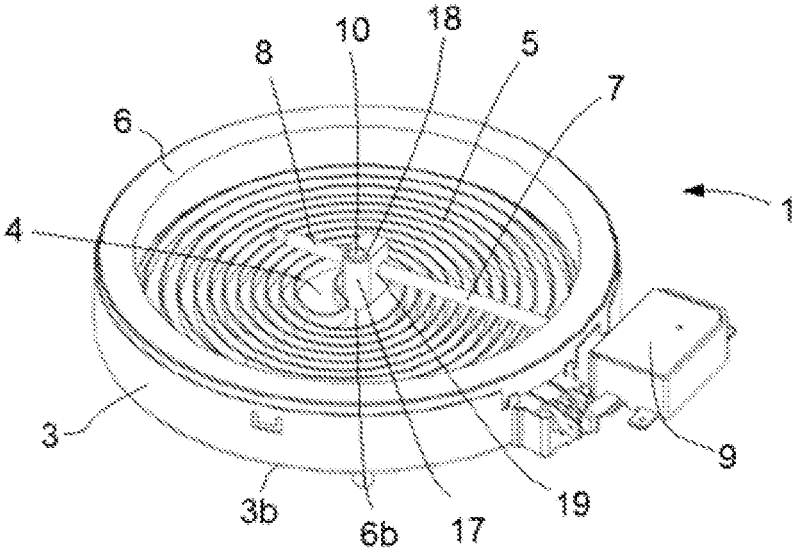
FIG. 2 is a perspective view of the radiant heater shown in FIG. 1.

In an embodiment that includes a second temperature sensor 8, the support 17 may further comprise a second hole 19, as shown in FIG. 2, through which the second temperature sensor 8 passes. According to one embodiment the first hole 18 and the second hole 19 of the support 17 are arranged orthogonal, or substantially orthogonal, to one another. In the embodiment shown in the drawings, the second temperature sensor 8 does pass across the entire radiant heater 1 with one end being supported by the support 17, as seen in FIG. 1.

In addition to having a function of housing the temperature sensor 10, and in some instances a second temperature sensor 8, the support 17 can also function to protect the temperature sensors against infrared radiation emitted by the radiant element 5, thereby protecting the temperature sensors from receiving direct infrared radiation, which would entail a mistaken reading of the temperature of the cookware arranged above the cooktop 2.

According to one embodiment the support 17 is made of a thermally and electrically insulating material, such as, for example, a ceramic material. According to other embodiments the support 17 may be made of vermiculite, steatite, cordierite or any other material known for these functions.

The invention claimed is:

1. A radiant heater assembly, comprising:

a cover having a base with a bottom side that faces downward, the cover having a through opening extending through the base, the through opening having a vertical central axis and a first cross-sectional area, an insulating base arranged on the cover, at least one resistance element positioned above the insulating base, a glass ceramic stovetop disposed above the at least one resistance element, the glass ceramic stovetop having a topside facing upward and a bottom side facing downward toward the at least one resistance element, a first temperature sensor configured for measuring the temperature of the glass ceramic stovetop when the glass ceramic stovetop is assembled on the radiant heater, the first temperature sensor having a body, the body having a cross-sectional area, elastic means suitable for keeping the temperature sensor in constant contact with the glass ceramic stovetop when the glass ceramic stovetop is assembled on the radiant heater assembly, the elastic means comprising a flat having a first end portion and a second end portion, the first end portion being fixed to the bottom side of the cover, the second end portion of the flat is not fixed to the cover and flexes vertically downward away from the bottom side of the cover when the glass ceramic stovetop is assembled on the radiant heater assembly, the temperature sensor being fixed to the second end of the flat, the flat is moveable between a rest position wherein both the first and second ends of the flat are arranged parallel to the bottom side of the cover and an active position wherein the second end of the flat forms an angle with the bottom side of the cover, wherein at the active position the second end of the flat is resiliently urged toward the bottom side so that when the glass ceramic stovetop is assembled on the radiant heater assembly the flat pushes the temperature sensor against the bottom side of the of the glass ceramic stovetop; and a vertically oriented support located above the insulating base arranged on the cover, the support including a through opening having a vertical central axis and a second cross-sectional area, the cross-sectional area of the body of the temperature sensor being less than the first and second cross sectional areas; the body of the temperature sensor extending through the through opening of the base of the cover and the through opening of the support;

when the glass ceramic stovetop is assembled on the radiant heater assembly, a first length of the body of the temperature sensor extends above a top end of the support by a first distance, when the glass ceramic stovetop is not assembled on the radiant heater assembly, a second length of the body of the temperature sensor extends above a top end of the support by a second distance greater than the first distance.

2. The radiant heater assembly according to claim 1, wherein the first temperature sensor has a longitudinal axis and is fixed to the flat with the longitudinal axis oriented a first angle with respect to a top side of the flat, the top side of the flat facing the bottom side of the cover.

3. The radiant heater assembly according to claim 2, wherein the top side of the flat forms a second angle with the bottom side of the cover, the first angle and second angle being complementary angles when the glass ceramic stovetop is assembled on the radiant heater.

4. The radiant heater assembly according to claim 1, wherein the body of the temperature sensor passes through a through opening within the insulating base, the through opening within the insulating base having a vertical central axis.

5. The radiant heater assembly according claim 4, wherein the support is arranged such that it is supported on the insulating base, centered with respect to the insulating base and comprising a first opening through which the first temperature sensor passes, the support comprising a material to protect the temperature sensor from infrared radiation.

6. The radiant heater assembly according to claim 5, further comprising a second temperature sensor having an end portion that is also supported by the support, the second temperature sensor arranged orthogonal to the first temperature sensor.

7. The radiant heater assembly according to claim 6, wherein the support includes a second opening having a horizontal central axis, the second temperature sensor passing through the second opening, the first and second openings being arranged orthogonal to one another.

* * * * *